United States Patent [19]

Houghton

[11] 4,347,039

[45] Aug. 31, 1982

[54] VARIABLE PITCH SCREW PROPELLER

[76] Inventor: Ronald Houghton, 16902 David Glen, Friendswood, Tex. 77546

[21] Appl. No.: 124,587

[22] Filed: Feb. 25, 1980

[51] Int. Cl.[3] ..... B63H 3/04

[52] U.S. Cl. ..... 416/167; 416/168 R

[58] Field of Search ..... 416/167, 168 R

[56] References Cited

U.S. PATENT DOCUMENTS

| | | | |
|---|---|---|---|
| 1,435,136 | 11/1922 | Hawes | 416/167 |
| 2,464,991 | 3/1949 | Roby | 416/167 |
| 2,763,329 | 9/1956 | Feroy | 416/167 |
| 3,912,417 | 10/1975 | Herbert | 416/167 |

FOREIGN PATENT DOCUMENTS

| | | | |
|---|---|---|---|
| 585673 | 10/1959 | Canada | 416/167 |
| 845930 | 8/1952 | Fed. Rep. of Germany | 416/167 |
| 805178 | 11/1936 | France | 416/168 |
| 1096293 | 6/1955 | France | 416/157 R |
| 1177322 | 4/1959 | France | 416/168 |
| 508212 | 1/1955 | Italy | 416/167 |

*Primary Examiner*—Everette A. Powell, Jr.
*Attorney, Agent, or Firm*—Vaden, Eickenroht, Thompson, Bednar & Jamison

[57] ABSTRACT

A variable pitch propeller is disclosed having a crank arm attached to the shaft of each propeller blade and a telescoping drive arm having one end pivotally attached to the propeller hub and the other end pivotally attached to a control rod. The telescoping arm rotates the crank arm to adjust the pitch of the propeller blades through an angle substantially greater than 90° as the control rod is moved longitudinally along the longitudinal axis of the hub of the propeller.

5 Claims, 7 Drawing Figures

FIG. 5
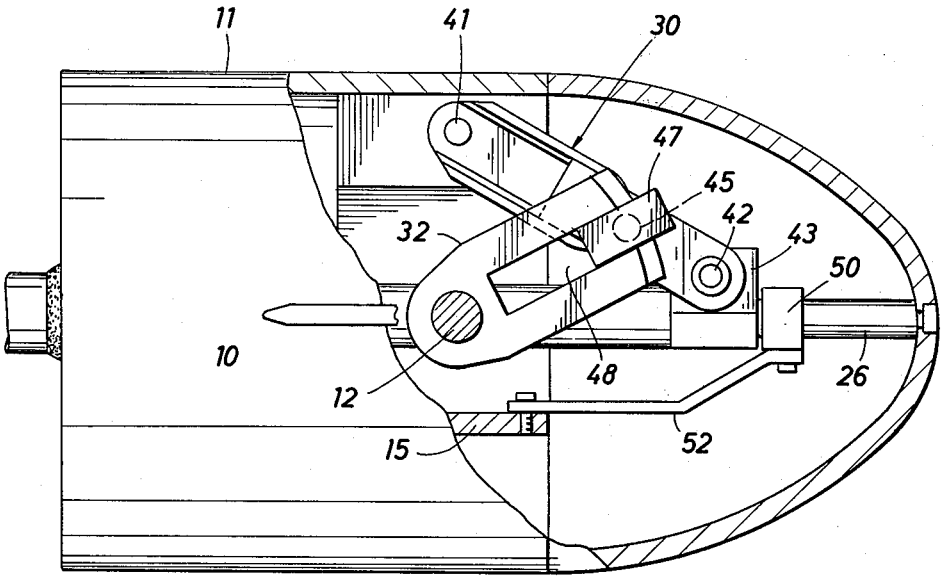
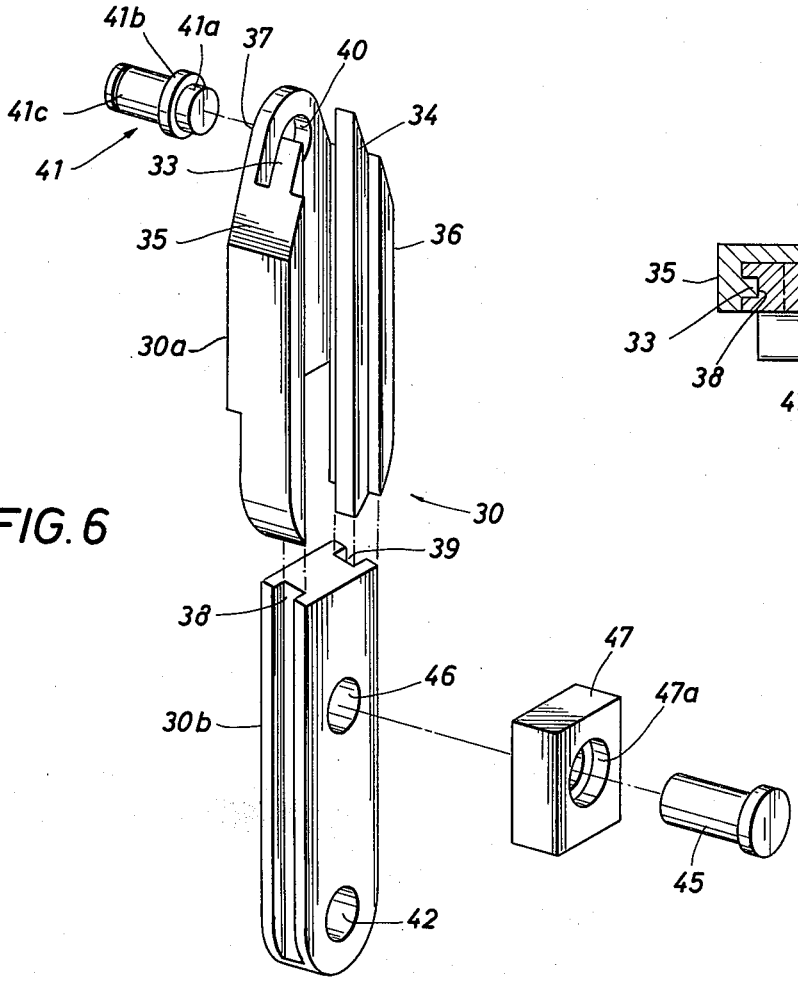
FIG. 6
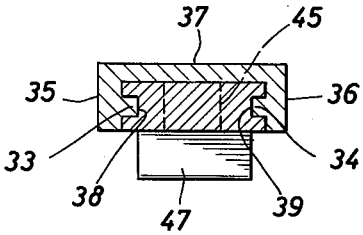
FIG. 7

VARIABLE PITCH SCREW PROPELLER

This invention relates to a variable pitch screw propeller for use in the marine field. It is particularly useful with auxiliary engines on sailboats.

For example, it is desirable that the propeller blades of the propeller of an auxiliary engine on a sailboat be moved to a position in-line with the direction of travel of the boat, when the auxiliary engine is not being used. This reduces the drag of the propeller through the water to a minimum. In order for the propeller blades to be so positioned and also positioned to provide forward and rearward thrust, the pitch of the blades must move through an angle greater than 90°.

It is an object of this invention to provide such a variable pitch screw propeller that can move the propeller blades through a pitch angle change of over 90° to provide both forward and rearward thrust and also position the blades in-line with the direction of travel of the boat or ship to reduce the drag of the propeller to a minimum.

It is another object of this invention to provide a variable pitch propeller that can be easily operated manually from inside the boat.

These and other objects, advantages and features of this invention will be apparent to those skilled in the art from a consideration of the specification, including the attached drawings and appended claims.

In the drawings wherein like reference characters are used throughout to designate like parts:

Figure 1:
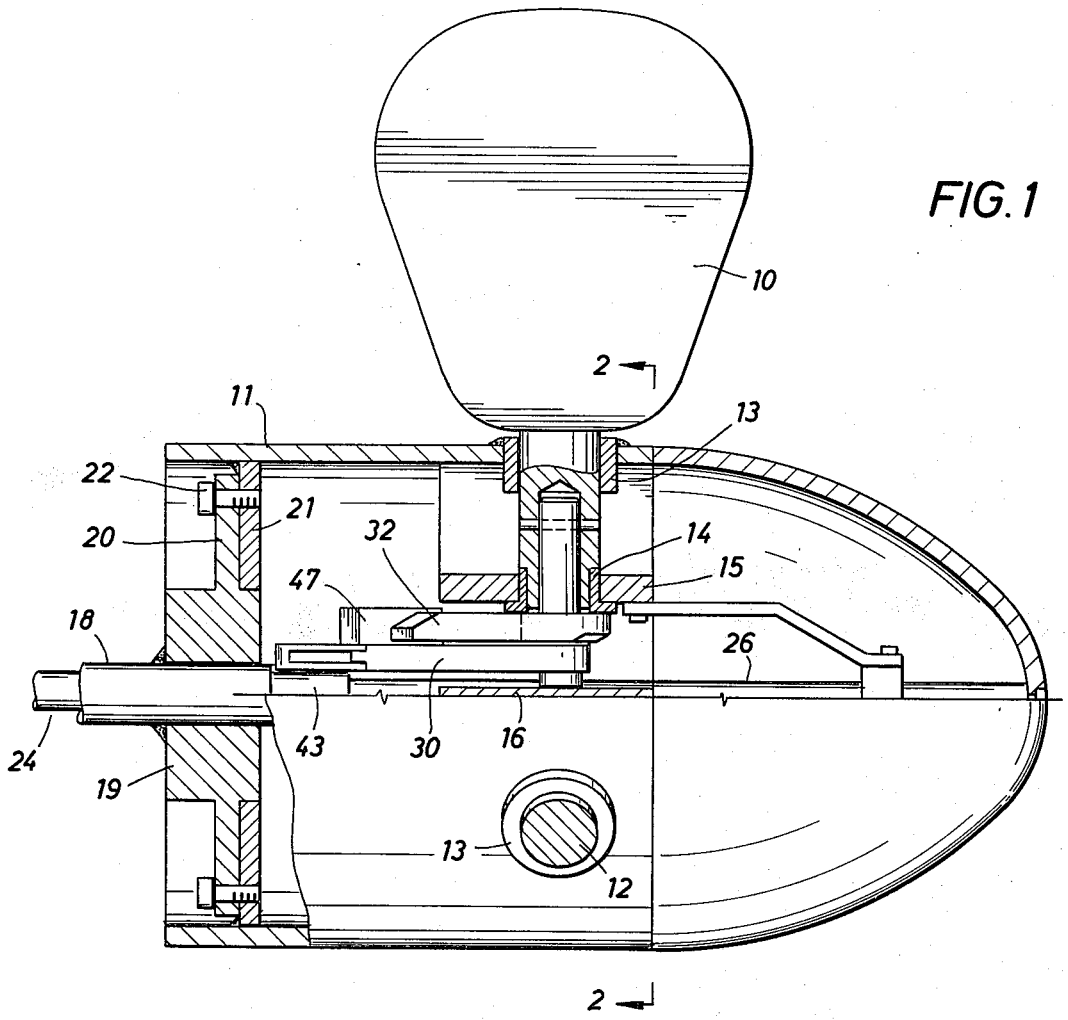
FIG. 1 is a side view, partially in section and partially in elevation, of the preferred embodiment of the variable pitch propeller of this invention.
Figure 3:
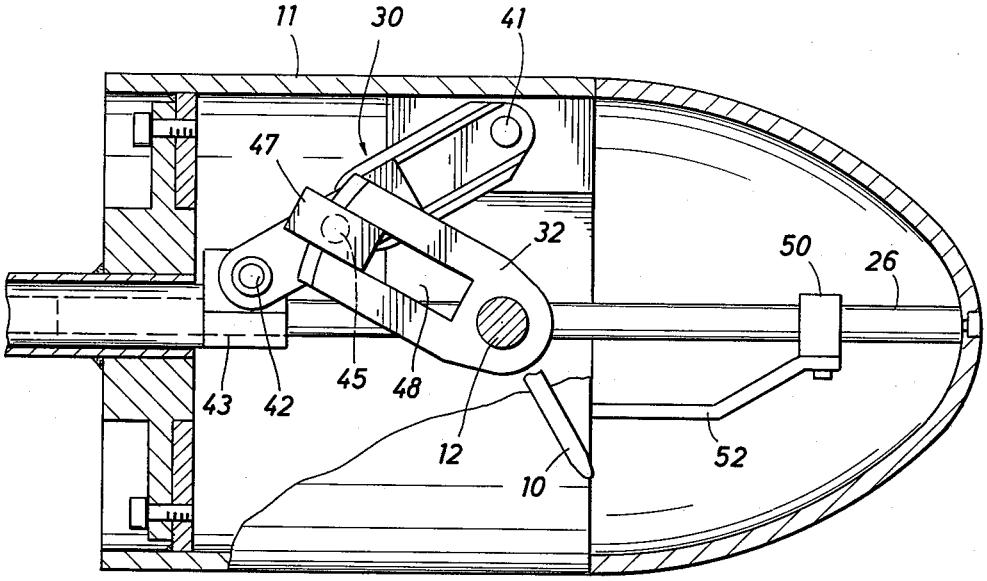
Figure 4:
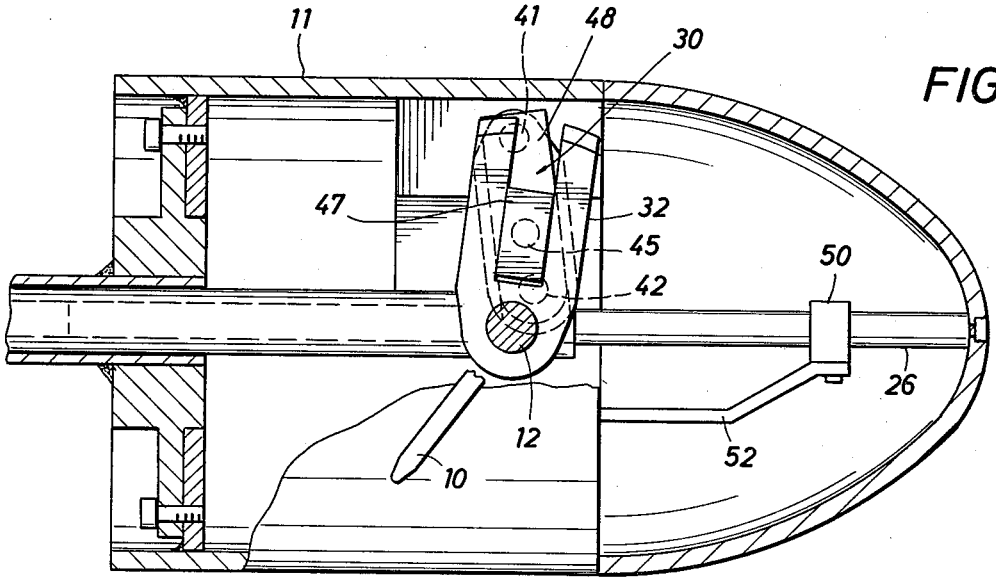

FIGS. 3, 4, and 5 are side views of the apparatus of FIG. 1 with a portion of the hub or housing of the variable pitch propeller broken away to show the various positions of the crank and drive arms as they change the pitch of the propeller blades;

FIG. 6 is an exploded view of the telescoping drive arm; and

FIG. 7 is a sectional view through the assembled telescoping arm of FIG. 6.

In the embodiment shown, the propeller includes three propeller blades indicated throughout the drawings by the number 10. Cylindrical housing or hub 11 houses the pitch adjusting portion of the propeller and also provides support for the propeller blades that extend laterally from the hub. Since in the embodiment shown three propeller blades are used, they extend laterally from the hub along lines 120° apart.

Each propeller blade is mounted in exactly the same way on the hub. Each propeller blade is attached to blade shaft 12, which extends through journal bearing 13 mounted in the wall of the hub. The end of the shaft that is located inside the hub is supported for rotation by bearing 14. Each inner bearing is supported by bearing plate 15 which is attached to hub 11 by rectangular mounting plates 16 and 17. For reasons that will be described below, it is important that mounting plate 16 lie in a plane that lies in a plane of or is parallel to a plane that intersects the longitudinal axis of the hub. For mounting plate 17, this is not so important.

In the embodiment shown, hub 11 and propeller blades 10 are rotated by hollow drive shaft 18. The drive shaft is connected to a motor, such as the auxiliary motor of a sailboat. The drive shaft extends through a central opening in drive ring 19 and is welded to the ring to cause the ring to rotate with the drive shaft. The drive ring has outwardly extending flange 20, which is connected to inwardly extending flange 21 by machine screws 22. Outer ring or flange 21 is welded to the inner surface of hub 11, as shown in FIG. 1.

Extending through the hollow drive shaft is control rod 24. The control rod is also hollow and slides on guide rod 26, which guides the control rod along the longitudinal axis of the hub, as the control rod is reciprocated on the guide rod through the hollow drive shaft. Key 25 is attached to the control rod and engages a keyway on the guide rod to hold the control rod from rotation relative to the guide rod.

The control rod rotates the propeller blades around the longitudinal axes of the blade shafts as it moves along guide rod 26. This movement is accomplished through two arms, telescoping drive arm 30 and crank arm 32. Two such arms are used to rotate each blade shaft. In FIGS. 3, 4, and 5 only one set of arms is shown to simplify the drawings.

Telescoping arm 30, as shown in FIG. 6, includes two sections 30*a* and 30*b*. Section 30*a* is generally U-shaped in cross section, as shown in FIG. 7, with two parallel ribs 33 and 34 extending longitudinally of the section along the inside walls of the two arms 35 and 36 that combine with base 37 to form the U-shaped section of the telescoping arm. Section 30*b* has longitudinally extending grooves 38 and 39 located on opposite sides of the section to receive ribs 33 and 34. The engagement of the ribs and grooves allows the two sections to have relative movement along the longitudinal axes of the two sections.

Figure 2:
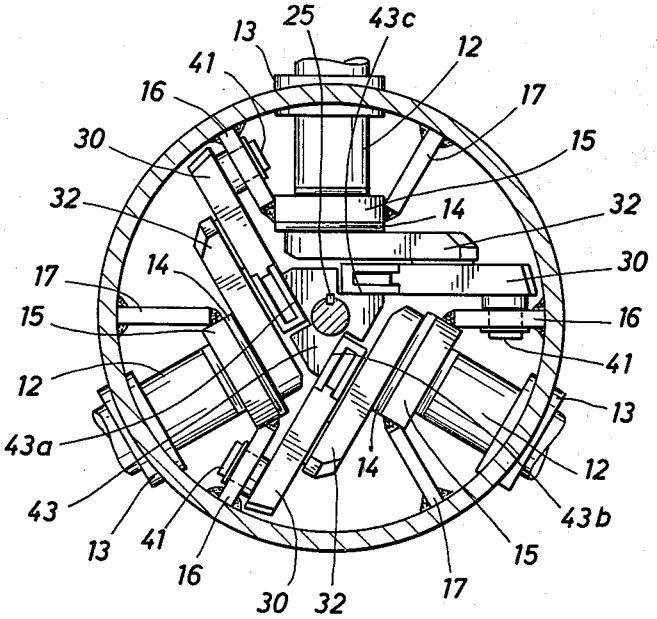
FIG. 2 is a sectional view taken along line 2—2 of FIG. 1.

Opening 40 in section 30*a* of the telescoping drive arm receives pivot pin 41, which connects this end of the telescoping arm to mounting plate 16 as shown in FIG. 2. Pivot pin 41 includes short cylindrical section 41*a* that is extended into opening 40 to the extent allowed by larger diameter section 40*b*. Section 41*a* is brazed or otherwise attached to section 30*a*. Section 41*c* extends to the opening provided in mounting plate 16 and provides the bearing surface for the rotation of telescoping arm 30 relative to the mounting plate.

The other section, section 30*b* is provided with opening 42*a* to receive pivot pin 42 that connects this end to drive block 43. Drive block 43 is provided with three surfaces 43*a*, 43*b*, and 43*c*, that are parallel to mounting plate 16 so that the ends of the telescoping arm pivot around the parallel axes of pivot pins 41 and 42. Drive block 43 is attached to the end of control rod 24.

Crank arm 32 is attached to propeller shaft 12 so that rotation of the crank arm will rotate the propeller shaft around its longitudinal axis and change the pitch of propeller blade 10. In the embodiment shown, crank arm 32 is rotated by the movement of telescoping arm 30 through pivot pin 45 the end of which is brazed in place in opening 46 in section 30*b* of the telescoping arm. Pivot pin 45 extends through opening 47*a* in rectangular block 47 and rotates relative thereto. Enlarged head 45*a* on the pin holds rectangular block on the pin. The parallel sides of the rectangular block engage slot 48 in the crank arm. Movement of the telescoping drive arm is thus transferred to the crank arm through the engagement of the sides of rectangular block 47 with the sides of slot 48 in the crank arm.

In operation, control rod 24 is moved longitudinally along the longitudinal axis of drive shaft 18 and keyed guide rod 26. This movement can be accomplished manually by the appropriate lever located inside the boat. Detents can be provided to hold the control rod in various positions to provide the propeller blades with the desired pitch. The pitch of the propeller blades can be adjusted from a position in-line with the direction of movement of the boat to offer a minimum amount of drag to the movement of the boat to a position to provide forward thrust and a position to provide rearward thrust. A detent for an in-between neutral position can be provided, if desired.

In FIG. 3 the control rod is in its forwardmost position with drive block 43 in engagement with the end of the drive shaft. In this position, propeller blade 10 is at an angle to the longitudinal axis of the drive shaft and can provide either forward or rearward thrust depending on the direction of rotation and the configuration of the blade. In FIG. 4 control rod 24 has moved approximately half way through its rearward stroke. Telescoping arm 30 has telescoped to allow pivot pin 41 and pivot pin 42 to move together to the extent required to allow the longitudinal movement of the control rod. Crank arm 32 has been rotated to position propeller blade 10 so that it will provide thrust in the opposite direction from that of FIG. 3.

Continued rearward movement of control rod 24 will move propeller blade 10 to a feathered position in-line with the direction of travel of the boat, as shown in FIG. 5. This is a particularly advantageous position with sailboats for in this position the propeller provides a minimum amount of drag.

In the embodiment shown, between the feathered position of FIG. 5 to the position of FIG. 3, the propeller blades are rotated through an angle of about 125°. The rearward movement of the control rod is limited by collar 50 mounted on guide rod 26. Lateral support for guide rod 26 is also provided by collar 50. Support brackets 51 are connected between collar 50 and bearing plates 15 to hold the collar and the guide rod from lateral movement.

Conically shaped fairing 54 may be attached to hub 11 to provide a smooth surface over which the water can flow.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A variable pitch screw propeller, including a hollow hub, a plurality of propeller blades, each blade attached to a blade shaft that extends through and is mounted in bearings in the hub wall with the propeller blade extending laterally of the hub for rotation with the hub and around the longitudinal axis of the blade shaft, a hollow drive shaft connected to the hub, a pitch control rod extending into the hub, means mounting the pitch control rod for movement along the longitudinal axis of the hub, means connecting the control rod with each blade shaft for rotation of the blade shafts in unison to change the pitch of the propeller blades as the control rod is moved axially relative to the hub through a sufficient angle of rotation to move the blades from a minimum drag feathered position in-line with the direction of movement of the hub to positions for providing forward thrust, no thrust, and rearward thrust upon rotation of the hub, said connecting means including a crank arm connected to each blade shaft for rotating the shafts around their longitudinal axes, a telescoping drive arm having one end pivotally connected to the hub and one end pivotally connected to the control arm, and a drive pin connected to one of the arms and engaging a slot in the other arm to cause the crank arm to rotate as the control rod is moved along its longitudinal axis.

2. The variable pitch screw propeller of claim 1 in which the drive pin is mounted on the telescoping drive arm and engages a slot extending longitudinally of the crank arm.

3. The variable pitch screw propeller of claim 1 in which the drive pin includes a drive head having an opening to receive the drive pin and opposite sides in sliding engagement with the slot in the crank arm.

4. The variable pitch screw propeller of claim 1 in which the pitch control rod is tubular and the control rod mounting means includes a guide rod extending through the control rod to guide the control rod as it is moved along the longitudinal axis of the hub.

5. A variable pitch screw propeller including a hollow hub, a plurality of propeller blades, each blade attached to a blade shaft that extends through and is mounted in bearings in the hub wall with the propeller blade extending laterally of the hub for rotation with the hub and around the longitudinal axis of the blade shaft, a hollow drive shaft connected to the hub, a pitch control rod extending through the drive shaft into the hub, means mounting the control rod for axial movement along the longitudinal axis of the hub, means connecting the control rod with each blade shaft for rotation of the blade shafts in unison to change the pitch of the propeller blades as the control rod is moved axially relative to the hub, through a sufficient angle of rotation to move the blades from a minimum drag feathered position in-line with the direction of movement of the hub to positions for providing forward thrust, no thrust, and rearward thrust upon rotation of the hub, said connecting means including a crank arm connected to each blade shaft for rotating the shafts around their longitudinal axes, a telescoping drive arm having one end pivotally connected to the hub and one end pivotally connected to the control arm, and a drive pin connected to one of the arms and engaging a lot in the other arm to cause the crank arm to rotate as the control rod is moved along its longitudinal axis.

* * * * *